US009862218B2

(12) United States Patent
Bianchi

(10) Patent No.: US 9,862,218 B2
(45) Date of Patent: Jan. 9, 2018

(54) METHOD FOR PRINTING ON A MEDIA OBJECT IN A FLATBED PRINTING SYSTEM

(71) Applicant: OCE-TECHNOLOGIES B.V., Venlo (NL)

(72) Inventor: Bruno Bianchi, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/095,561

(22) Filed: Apr. 11, 2016

(65) Prior Publication Data

US 2016/0311240 A1 Oct. 27, 2016

(30) Foreign Application Priority Data

Apr. 24, 2015 (EP) ..... 15165105

(51) Int. Cl.

| | |
|---|---|
| ***B41J 3/28*** | (2006.01) |
| ***B41J 29/393*** | (2006.01) |
| ***B41J 3/44*** | (2006.01) |
| ***B41J 11/00*** | (2006.01) |

(52) U.S. Cl.

CPC ..... *B41J 29/393* (2013.01); *B41J 3/28* (2013.01); *B41J 3/445* (2013.01); *B41J 11/008* (2013.01)

(58) Field of Classification Search

CPC ..... B41J 29/393; B41J 29/3935; B41J 29/38; B41J 3/445; B41J 3/4073; B41J 2/00

See application file for complete search history.

(56) References Cited

U.S. PATENT DOCUMENTS

2005/0057593 A1 3/2005 Kachi
2011/0273504 A1* 11/2011 Boesten ..... B41J 2/2128 347/14
2012/0256995 A1 10/2012 Holzer et al.

FOREIGN PATENT DOCUMENTS

| | | | |
|---|---|---|---|
| EP | 2 508 347 | A1 | 10/2012 |
| EP | 2 803 492 | A1 | 11/2014 |
| EP | 2905143 | A1 | 8/2015 |
| WO | WO 2013/005204 | A1 | 1/2013 |

OTHER PUBLICATIONS

Barth, A, Tessellations: The Link Between Math and Art, Apr. 27, 2007, p. 9.*

* cited by examiner

*Primary Examiner* — Sharon A Polk
(74) *Attorney, Agent, or Firm* — Birch, Stewart, Kolasch & Birch, LLP

(57) ABSTRACT

The invention relates to a method for printing on a media object supported by a flat bed of a printer, the printer comprising a print head and a camera above the flat bed, the method comprising the steps of detecting a media object on the flat bed surface of the printer by means of a digital camera image captured by the camera, deriving camera coordinates of the media object in the digital camera image, applying a direct transformation from the camera coordinates into print head coordinates of the media object without using coordinates of the flat bed surface, and printing a digital target image on the media object by ejecting recording material on the media object from the print head, the print head controlled according to the print head coordinates appropriate for the media object.

12 Claims, 5 Drawing Sheets

METHOD FOR PRINTING ON A MEDIA OBJECT IN A FLATBED PRINTING SYSTEM

FIELD OF THE INVENTION

The present invention relates to a method for printing on a media object supported by a flat bed of a printer, the printer comprising a print head that is controlled to move over the media object using print head coordinates, and a camera above the flat bed, the method comprising the steps of detecting a media object on the flat bed surface of the printer by means of a digital camera image captured by the camera, and deriving camera coordinates of the media object in the digital camera image.

The present invention also relates to a flatbed printer comprising a flatbed surface for placing a media object to be printed upon, a control unit for controlling the printing of a digital image on the media object, a print head for ejecting recording material on the media object, the print head relatively movable with respect to the flat bed surface. The control unit is configured to execute the method according to the invention.

The present invention further relates to a computer program product, including computer readable code embodied on a computer readable medium, said computer readable code comprising instructions for generating a print according to the method of the invention.

BACKGROUND OF THE INVENTION

The print head of the flat bed printer may be mounted on a gantry above the flatbed surface. In case of a gantry, the gantry may be moving over the flat bed surface in a first direction, while the print head is movable along the gantry in a second direction perpendicular to the first direction. In case of a print head having a same width as the flat bed surface, the print head may be moving in one direction over the flat bed surface. The control unit is connected to the print head for controlling the print head. The control unit is also controlling the movement of the print head over the flat bed surface. The distance from the print head to the flat bed surface may be variable in order to allow the printing of 3D images.

The recording material may be hot melt ink or a UV curable ink. When the latter ink is used, the print head is also provided with UV lamps for curing the recording material when ejected on the media object placed on the flatbed surface. The flatbed surface usually has the form of a rectangle, for example of a width of 1.22 m and a length of 1.22 m, or of a width of 1.22 m and a length of 2.44 m.

A media object with dimensions in the plane of the flat bed surface smaller or equal to the dimensions of the flat bed surface can be placed on the flat bed surface. The media object has a height in a direction perpendicular to the flat bed surface. Flat bed print systems usually apply recording material, like colorants, on a media object placed on the flat bed in the form of toner or ink according to a digitally defined, two-dimensional pattern of pixels with values that indicate a composition of these colorants. This pattern is generated out of a target digital image, that may comprise objects in either vectorized or rasterized format, using conventional techniques like interpretation, rendering, and screening by a raster image processor. The processing of a target digital image includes colour management to convert colour values of the pixels in the target digital image into composition values related to the printer colour space as is set up by the colorants of the print system. Depending on the intended print quality and the characteristics of the print process, the pixels of the pattern may be printed in more than one pass, wherein a position of the media object on the flat bed has an opportunity to receive a colorant in one or more of the passes of the print head across the flat bed.

The printer also comprises a camera for capturing digital camera images from the flat bed surface. The camera is positioned above the flat bed surface. The reach of the camera includes at least part of the flat bed surface, but preferably the whole flat bed surface. If a media object has been placed on the flat bed and the camera captures a digital camera image, an image processing component of the control unit is configured to derive camera coordinates of the media object in the captured digital camera image.

An operator may place a media object on the flatbed surface in order to print a digital target image on the media object. The digital target image has been offered to the control unit. The media object may be a paper sheet, a plastic sheet, canvas, a glass plate, a plastic plate, a wooden board, a plastic board, a metallic board, a wooden panel, a plastic panel, a metallic panel or a sheet, plate, panel or board of a different kind of receiving media.

The flatbed printer comprises a camera system connected to the control unit and positioned above the flatbed surface. The camera system comprises a camera above the flat bed surface at a predetermined height from the flat bed surface. The camera is calibrated to take digital camera images of the flat bed surface. Each location in a digital camera image taken by the camera corresponds to a position in the plane of the flat bed surface. A non-linear calculation executed by the image processing component in the control unit couples a pixel in the digital camera image to a position of the flat bed surface. The image processing component is configured to analyse the digital camera image of the flat bed surface in order to detect a media object placed on the flat bed surface.

According to the prior art actual coordinates of points on the media object on the flat bed surface corresponding to points of the media object in the digital camera image are calculated by the control unit. Then another calculation derives print head coordinates from the actual coordinates of points of the media object. The print head coordinates are coordinates of a position of the print head when ejecting recording material on the media object. The print head coordinates are derived via coordinates of the flat bed surface. By using the coordinates of the flat bed surface more calculations and calibrations are necessary and errors like approximation errors are introduced. This way of working leads to an inaccuracy in determining the print head coordinates.

It is an objective of the present invention to achieve an increase of the accuracy of the determination of the print head coordinates and thus to achieve a better print quality of a print on the media object.

SUMMARY OF THE INVENTION

The objective may be achieved by the method according to the present invention, wherein the method comprising the steps of converting the camera coordinates indicating a shape and a size of the media object into print head coordinates of the media object using a mapping table, arranging a digital target image relative to the print head coordinates of the media object, and printing the digital target image on the media object by ejecting recording material on the media object from the print head.

The inventor has realised that the print head coordinates are directly derivable from the camera coordinates without using the flat bed surface coordinates of the media object. The position of the flat bed becomes irrelevant. The method takes at once into account printer defects, like unlinearity, and camera defects, like aberrations. By using the method of the invention, a characterization of the mentioned defects is not needed to compute. The accuracy of the print head coordinates of the media object is optimized.

According to an embodiment of the method the mapping table is established by applying the steps of printing a reference image on a substrate supported by the flat bed surface, the reference image comprising geometric patterns which are defined in print head coordinates, capturing a reference digital camera image of the printed reference image by means of the camera, detecting the geometric patterns in the reference digital camera image, expressing the detected geometric patterns in reference camera coordinates, and determining a relation between the reference camera coordinates and the print head coordinates of the detected geometry patterns.

The determined relation defines the mapping table. The mapping table is used according to the invention for controlling and positioning the print head of the printer when printing a digital target image on a media object supported by the flat bed surface.

According to an embodiment of the method the geometric patterns form a part of a tessellation of a two-dimensional Euclidian plane.

According to an embodiment of the method the tessellation comprises a plurality of tiles having corners, the mapping table comprises for each corner an entry comprising the camera coordinates of a corner and the corresponding print head coordinates, and the converting step comprises an interpolation step for camera coordinates within a tile into print head coordinates.

According to an embodiment of the method neighboring tiles in the tessellation have contrasting colors.

According to an embodiment a border of each tile of the tessellation has a contrasting color with the inside area of the tile.

The present invention also relates to a flatbed printer comprising a flatbed surface for supporting a media object to be printed upon, a control unit for controlling the printing of a digital image on the media object, a print head for ejecting recording material on the media, the print head movable relatively to the flat bed surface according the print head coordinates, and a camera connected to the control unit and positioned above the flatbed surface, the camera configured to capture a camera image from the flatbed surface, wherein the control unit comprises image processing component for detecting a media object placed on the flatbed surface in the camera image captured by the camera and the control unit is configured to derive camera coordinates of the media object in the digital camera image, to convert the camera coordinates indicating a shape and a size of the media object into print head coordinates of the media object using a mapping table, to arrange a digital target image relative to the print head coordinates of the media object, and the print head is configured to print the digital target image on the media object by ejecting recording material on the media object. The invention also relates to a recording medium comprising computer executable program code configured to instruct a computer to perform a method according to the invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

Hereinafter the present invention is further elucidated with references to the appended drawings showing non-limiting embodiments and wherein.

DETAILED DESCRIPTION OF EMBODIMENTS

Figure 1:
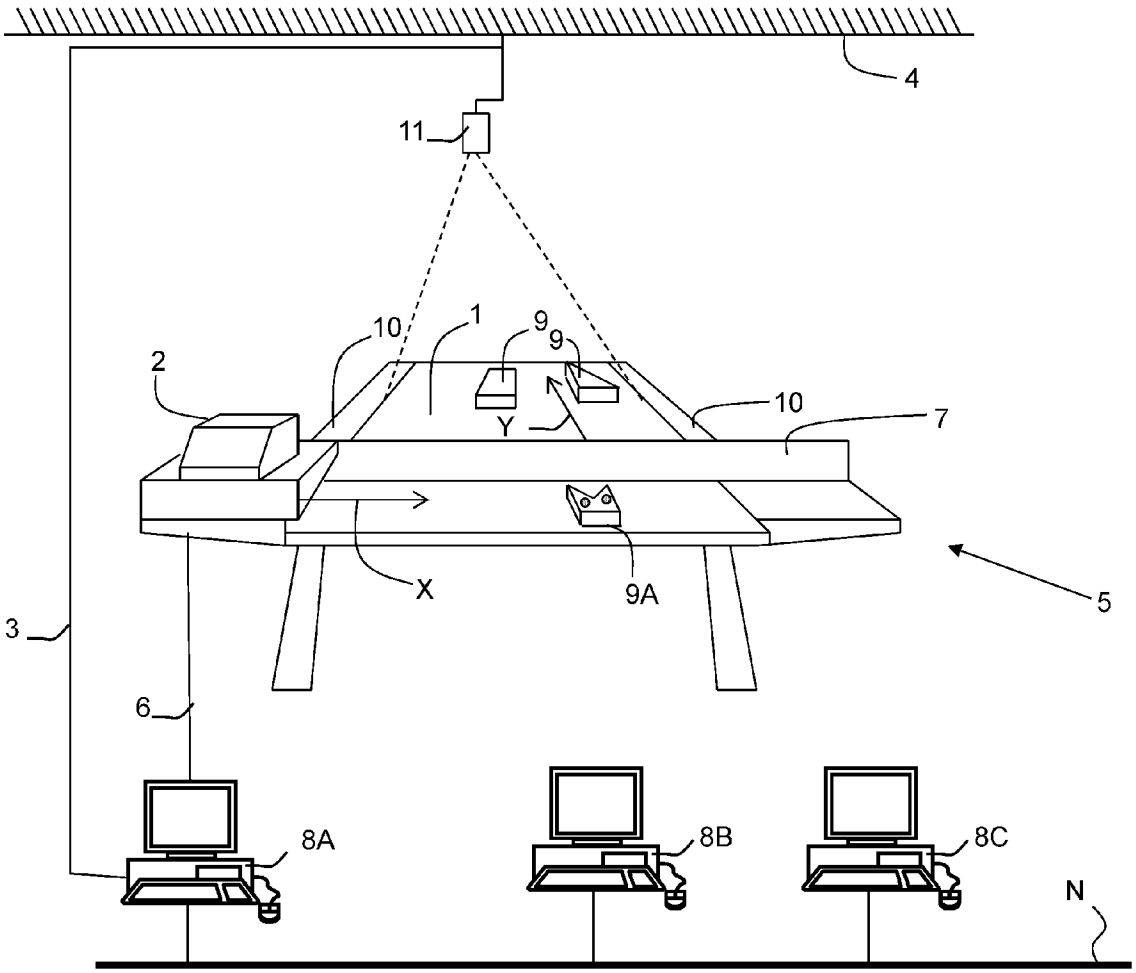
FIG. 1 shows a printer configured to apply the invented method.

FIG. 1 shows a printer 5 comprising a number of workstations 8B, 8C, which may be personal computers, remote devices, mobile devices or other devices for preparing image data for prints to be printed. These workstations have access to a network N for transferring the image data to a print controller 8A that is configured to receive print jobs for prints and derive pass images. The print controller 8A may be part of the printer 5 that further comprises a print head 2 for applying colorants, for example cyan (C), magenta (M), yellow (Y), black (K) and white (W) colorant, or varnish to media objects 9, 9A placed on a flat bed surface 1 in order to obtain a printed image on the media objects 9, 9A. The flat bed surface 1 is the surface of the flat bed which is at least partially printable by the print head 2. It is noted that the media objects may be of an arbitrary shape and at an arbitrary position on the flat bed surface 1. The media objects may be so small that they are completely placed on the flat bed surface 1 and have a height that is convenient for the perpendicular distance of the print head 2 to the flat bed surface 1. A first media object 9A has already been printed upon, while the other media objects 9 are not provided with any recording material yet. The print head 2 reciprocally scan the flat bed surface 1 in the second direction X along a gantry 7 perpendicular to a first direction Y of the gantry 7 over the flat bed surface 1 along guiding parts 10. During printing of an image on the media object 9, 9A the media object 9, 9A is not moved on the flat bed surface 1. This way of working is advantageous for rigid media objects. A material of the media objects 9, 9A may be paper, wood, glass, plexi-glass, plastic, board, textile, etc. A print head which is as wide as the flat bed surface may also be envisaged within the scope of the invention. Such a print head may be moveable in at least one direction over the flat bed surface 1.

Above the flat bed surface 1 a camera 11 is placed which is connected via a wired or wireless (not shown) network connection 3 with the print controller 8A. The camera 11 is, for example, attached to the ceiling 4 of a room in which the printer 5 resides. Other bodies for attaching the camera like a framework or a pole may be envisaged. The camera may also be attached to the print head or to the gantry. The reach of the camera 11 is at least the whole flat bed surface 1 as indicated by dashed lines in FIG. 1. The reach of the camera 11 may be extended to the guiding parts 10.

The camera optical centre may be for example approximately 226 cm above the flat bed surface. According to another embodiment digital images are projected on the flatbed surface by means of a projector (not shown) residing near the camera and afterwards media objects 9, 9A are placed on the flatbed surface, for example at the locations of the projected digital images. Then the media objects 9, 9A are detected by the camera 11.

The printer comprises a user interface which, in this embodiment, is integrated in printer controller 8A for selecting a print job and optionally adapting a print job parameter, such as a print mode which controls the number of passes over a given swath on the media object. In another embodiment a user interface is provided as a network site that is accessible with a browser on a client computer.

After sending a print job comprising image data from a workstation to the printer controller 8A, the print job will be made visible on the user interface. It may be scheduled for further processing after selection from a list of print jobs or, alternatively, if the print job is at the head of the list of print jobs. The print job comprises parameter values that determine the way the image data are to be printed, such as the manner the image data are to be converted into print data.

Figure 2:
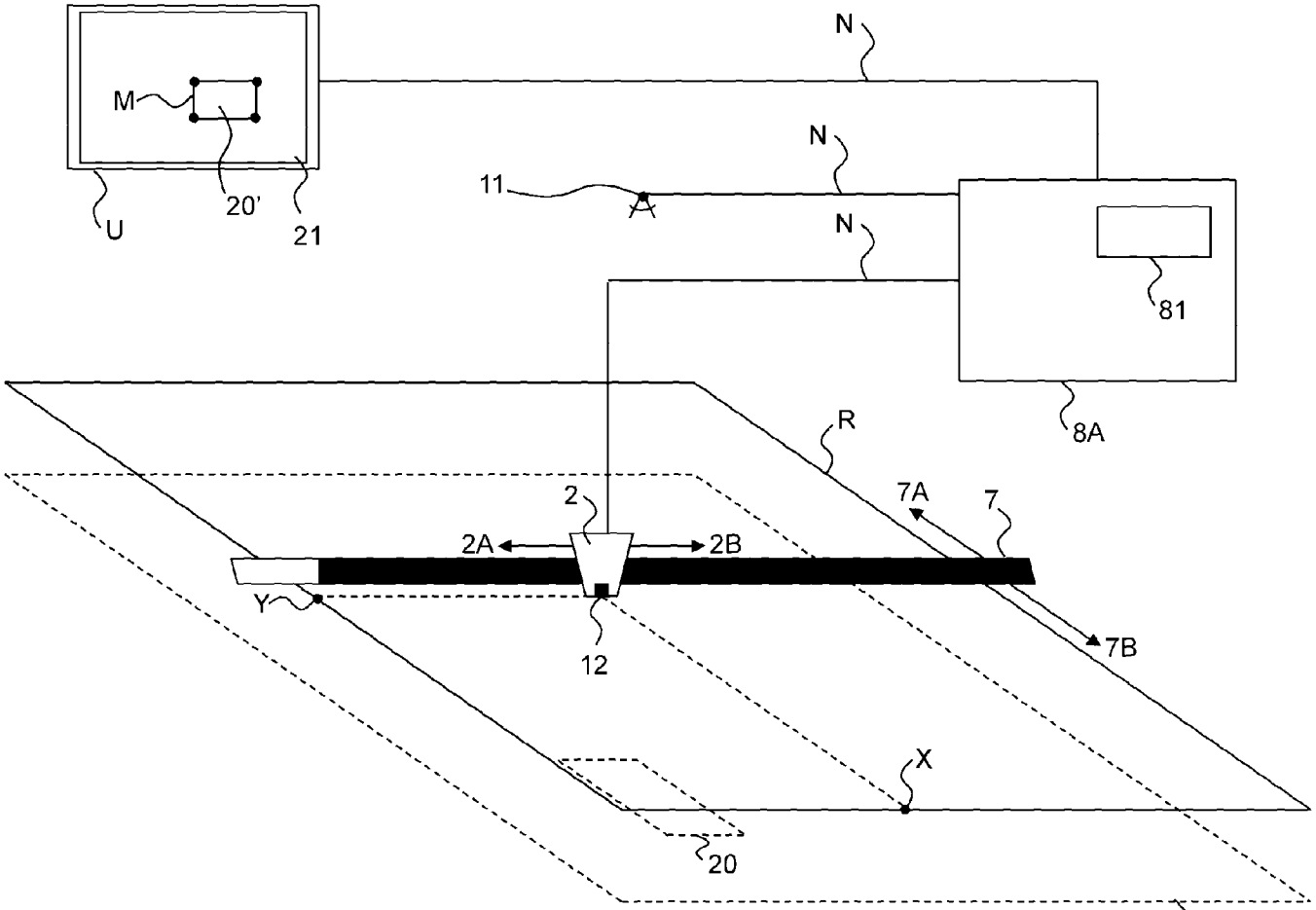
FIG. 2 is a schematic view of a camera and a print head positioned above on the flat bed surface of a printer according to the invention.
Figure 3:
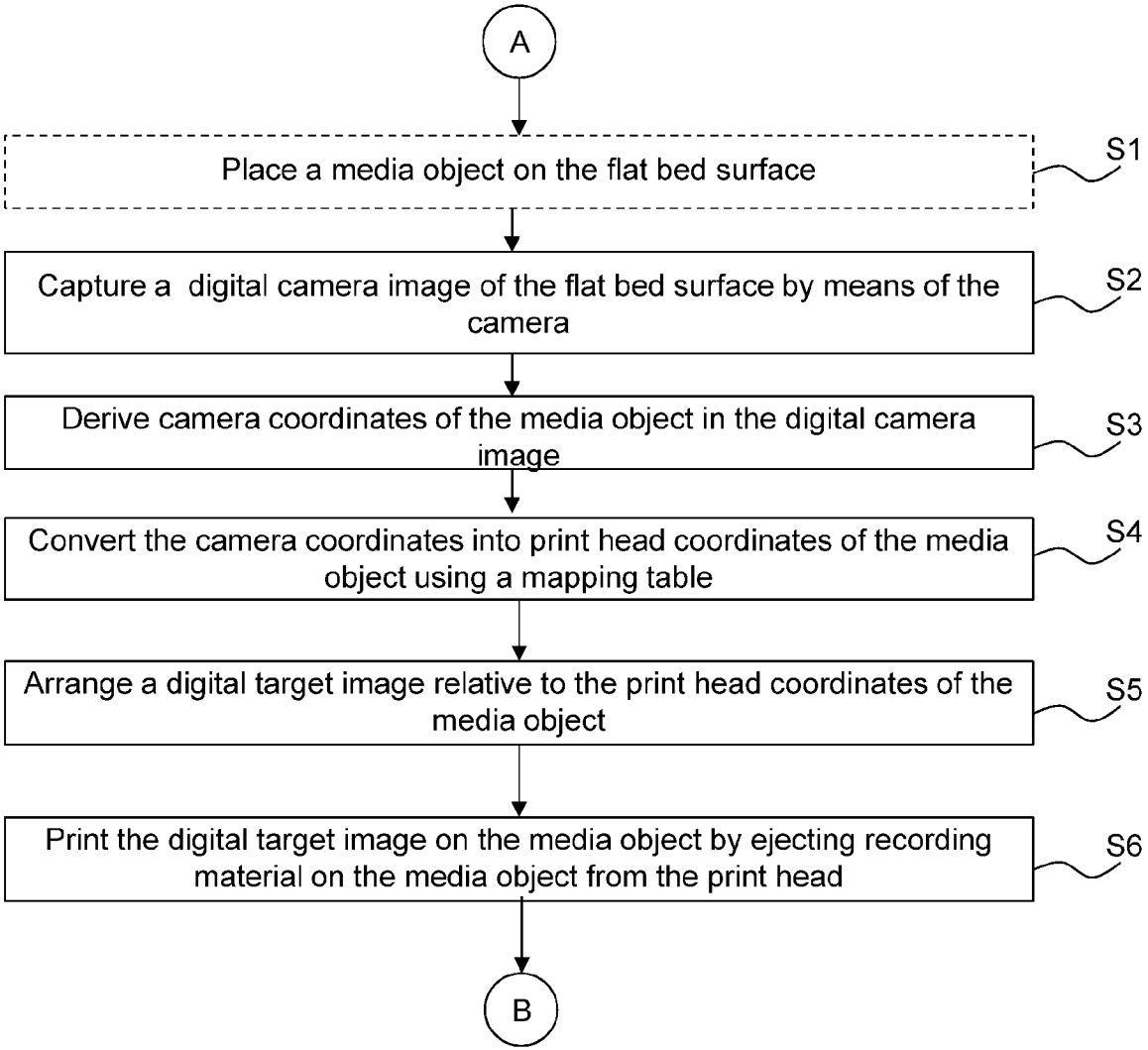
FIG. 3 is a flow diagram of an embodiment of a method according to the invention.

An embodiment of the method according the invention will be explained by means of FIG. 2 showing a schematic view of a camera and a print head positioned above on the flat bed surface of a printer according to the invention and by means of FIG. 3 showing a flow diagram of the embodiment.

The embodiment of the method starts in starting point A leading to a first step S1.

The first step S1 may be executed by the operator or robot indicated by the dashed rectangle block, while the other steps S2, S3, S4, S5, S6 may be executed by means of the control unit 8A in FIG. 1 and the printer 5 in FIG. 1.

In the first step S1 the operator or placing device like a robot places a media object 20 on the flat bed surface 1 as shown in FIG. 3. The camera 11 which may be switched on when the printer 5 (See FIG. 1) is switched on, registers every placing of a media object on the flat bed surface 1. The registering signals are sent to the printer controller 8A by means of the connection N. The printer controller 8A comprises an image processing component (not shown) which generates a digital camera image 21 of the flat bed surface 1 and everything in the reach of the camera 11 towards the flatbed surface 1.

In a second step S2 the camera 11 which is positioned above the flat bed surface 1 captures a digital camera image 21. The digital camera image 21 may be shown on a user interface screen U connected to the printer controller 8A via the network N. A part 20' of the digital camera image 21 represents the media object 20 placed on the flat bed surface 1.

In a third step S3 camera coordinates of the part 20' representing the media object 20 are derived from the digital camera image 21. An image processing component 81 of the printer controller 8A comprises software and/or hardware for detecting the part 20' representing the media object 20 in the digital camera image 21, in particular the contour M of the media object 20. The detection of the contour M may be realised by using a known erosion image processing technique for extracting a boundary of a geometric two-dimensional object. Among the points detected on the contour M are the corner points of the contour M of the part 20' representing the corners of the media object 20. The media object 20 may be placed according to—aligned to—the directions 2A-2B, 7A-7B in the flat bed surface 1. However, the method according to the invention is not limited to such an alignment of the media object 20 on the flat bed surface 1 and is applicable to each position of the media object 20 on the flat bed surface 1.

In a fourth step S4 the camera coordinates of the part 20' are converted into print head coordinates suitable for printing on the media object 20 by means of a mapping table. The conversion may be carried out by means of the image processing component 81 in the printer controller 8A. The print head coordinates are set in a plane R at the height level of a nozzle 12 of the print head 2. The position of the nozzle 12 may be described by an X and Y coordinate as shown in FIG. 3 but other coordinate axes in the plane R may be envisioned.

In a fifth step S5 a digital target image is arranged relative to the print head coordinates of the media object 20. The digital target image may be retrieved from storage of the printer controller 8A and rotated, scaled, translated and/or mirrored in order to fit on the media object 20 when printing the digital target image.

In a sixth step S6 a digital target image is printed on the media object 20 by ejecting recording material on the media object 20 from the nozzle 12 of the print head 2. The position of the print head 20 is controlled by the printer controller 8A according to the print head coordinates (X, Y) appropriate for printing on the media object 20. The print head 2 is able to move along the gantry 7 in a first direction 2A or in a second direction 2B. The gantry 7 is able to move relatively to the flat bed surface 1 in a third direction 7A or in a fourth direction 7B.

In another embodiment the flat bed surface is a flat conveyor belt construction on which the media objects are automatically placed by a robotic device. Another image processing component may be used to create a set of digital images when registering the moving media objects on the belt. In this embodiment a gantry may be stationary while the print head is as wide as the length of the gantry across the belt as to be able to eject recording material along the whole surface of the conveyor belt.

It is noted that the flat bed surface position is not part of the conversion from camera coordinates into print head coordinates, but the conversion directly converts the camera coordinates into the print head coordinates.

The method ends in an end point B.

Figure 4:
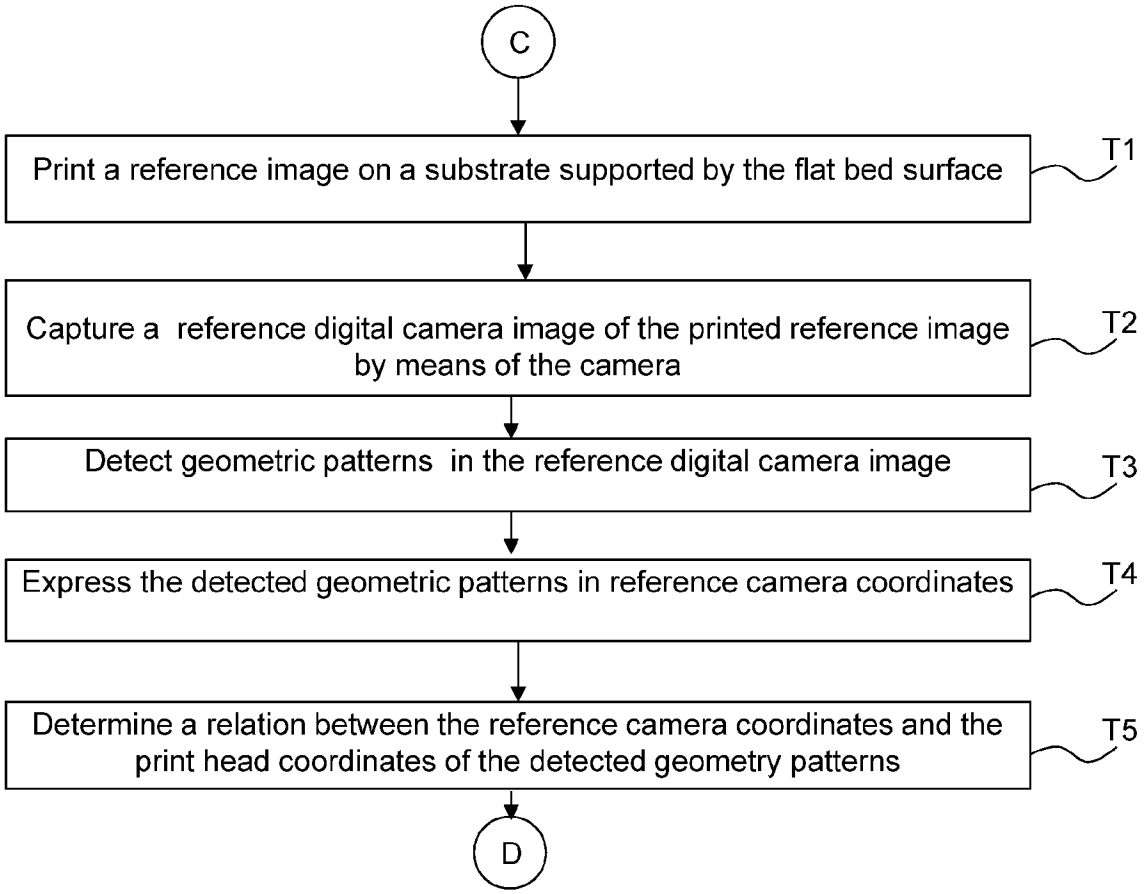
FIG. 4 is a flow diagram of an embodiment of establishing the mapping table of the method according to the invention.

According to a further embodiment of the method shown in FIG. 4 the step of establishing of the mapping table for converting the camera coordinates into print head coordinates will be elucidated.

The further embodiment of the method starts in starting point C and leads to a first step T1.

Figure 5:
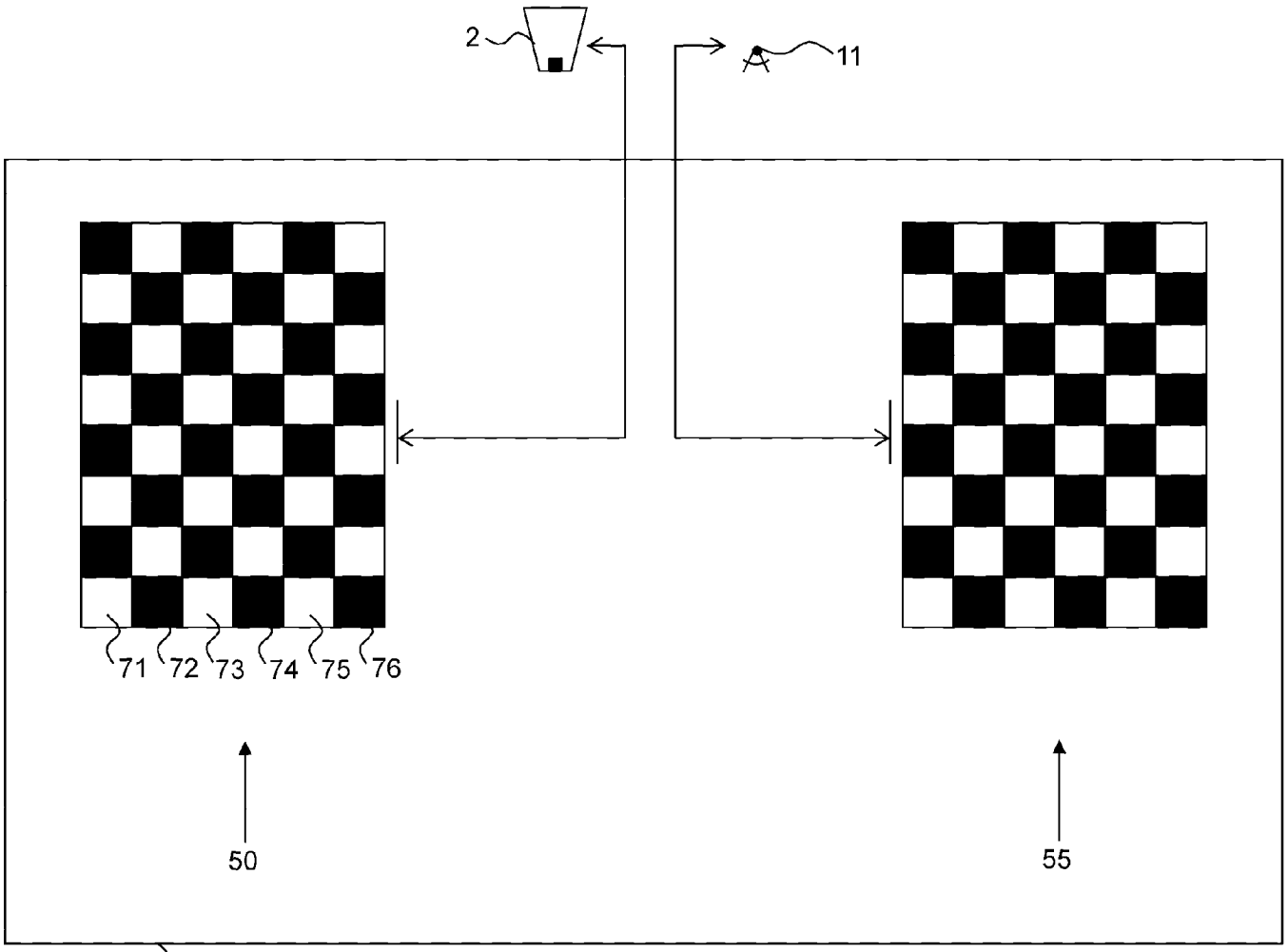
FIG. 5 is an example of a reference image for calibrating the camera with respect to a print head position above on the flat bed surface of a printer according to the invention.

In the first step T1 a digital reference image 50 as shown in FIG. 5 is printed on a substrate (not shown) supported by the flat bed surface of the printer according to the invention, for example the printer 5 (FIG. 1).

In a second step T2 a reference digital camera image 55 of the printed reference image 50 is captured by means of the camera of the printer according to the invention.

In a third step T3 geometric patterns 71-76 are detected on the printed substrate captured in the reference digital camera image 55.

In a fourth step T4 the detected geometric patterns 71-76 are expressed in reference camera coordinates.

In a fifth step T5 a relation is determined between the reference camera coordinates and the print head coordinates of the detected geometry patterns.

The further embodiment of the method according to the invention ends in an end point D.

FIG. 5 is an example of a digital reference image 50 for calibrating the camera 11 with respect to a print head position of the print head 2 above on the flat bed surface of a printer according to the invention.

The digital reference image 50 comprises geometric patterns. The geometric patterns are squares 71-76 which are alternately black and white coloured. Other contrasting colours than black and white may be envisioned. The geometric patterns form a chess board pattern. A border of a geometric pattern may have a colour contrasting with the inside area of the geometric pattern. The digital reference image 50 is printed by means of the print head 2 on a substrate supported by the flat bed surface. A relative small number of geometric patterns is shown for convenience reasons, but a larger number of geometric patterns may be envisioned, for example in line with the resolution of the camera 11.

The invention is not limited to a chess board pattern. Other geometric patterns may be used which form a part of a tessellation of a Euclidian plan. The pattern may comprise tessellation lines or filled tiles (like the chess board pattern), for instance based on triangles, squares, rectangles, trapezoids, hexagons, etc. The corner coordinates of the tessellation on the digital reference image 50 are known by the control unit 8A, since the digital reference image 50 is analysed by the control unit 8A. During the analysis by the control unit 8A a corner coordinate is directly coupled to a print head coordinates in accordance with the position of the print head 2 when the corner of the digital reference image 50 is printed.

The corners of the tessellation on the printed reference image in the reference digital camera image 55 are captured by the camera 11. The corners of the tessellation in the reference digital camera image 55 are detected in the reference digital camera image 55. The reference camera coordinates of the corners of the tessellation in the reference digital camera image 55 are used to form entries of the mapping table. The reference digital camera image 55 is analysed by the control unit 8A.

The detection of the corners of a tile in the reference digital camera image 55 may be established by using a binarisation step, for example based on a well-known K-means algorithm, a skeleton step for detection of contours, for example based on mathematical morphology, Laplace filters and erosion operations, and a corner detection step. The corner detection step may use a Kernel filter for detecting points which are likely corners, a segmentation algorithm for segmenting the detected points into regions of one or more pixels and a classification algorithm for labelling and classifying the regions into several classes. The camera corner coordinates of a corner may be derived as the average of the pixel coordinates of a class.

The conversion is defined according to a mapping table between the camera coordinates of the corners of tiles in the reference digital camera image 55 and associated print head coordinates derived from the digital reference image 50. For coordinates of a position within a tile in the digital reference image 50 a two-dimensional interpolation function may be used.

The here-above mentioned mappings, algorithms, filters, interpolation functions are preferably implemented in hardware and/or software as being part of the control unit 8A.

The above disclosure is intended as merely exemplary, and not to limit the scope of the invention, which is to be determined by reference to the following claims.

The invention claimed is:

1. A method for printing on a media object supported by a flatbed of a printer, the printer comprising a print head that is controlled to move over the media object using print head coordinates, and a camera above the flatbed, having a reach of the whole flatbed surface at one time, the method comprising the steps of:

detecting a media object on the flatbed surface of the printer from a digital camera image captured by the camera, deriving camera coordinates of the media object in the digital camera image, converting the camera coordinates indicating a shape and a size of the media object into print head coordinates of the media object using a mapping table, arranging a digital target image relative to the print head coordinates of the media object, and printing the digital target image on the media object by ejecting recording material on the media object from the print head, wherein the mapping table is established prior to printing the digital target image by applying the steps of:

printing a reference image on a substrate supported by the flatbed surface, wherein the substrate is separate from the media object and the reference image comprises geometric patterns which are defined in print head coordinates, capturing a reference digital camera image of the printed reference image by means of the camera, detecting the geometric patterns in the reference digital camera image, and expressing the detected geometric patterns in reference camera coordinates, and determining a relation between the reference camera coordinates and the print head coordinates of the detected geometry patterns.

2. The method according to claim 1, wherein the geometric patterns form a part of a tessellation of a two-dimensional Euclidian plane.

3. The method according to claim 2, wherein the tessellation comprises a plurality of tiles having corners, the mapping table comprises for each corner an entry comprising the camera coordinates of a corner and the corresponding print head coordinates, and the converting step comprises an interpolation step for camera coordinates within a tile into print head coordinates.

4. The method according to claim 3, wherein neighboring tiles in the tessellation have contrasting colors.

5. The method according to claim 3, wherein a border of each tile of the tessellation has a contrasting color with the inside area of the tile.

6. The method according to claim 1, wherein the step of arranging the digital target image comprising at least one step out of rotating, scaling, translating and mirroring the target image.

7. A recording medium comprising non-transitory computer executable program code configured to instruct a computer to perform a method according to claim 1.

8. The method according to claim 1, wherein the camera is separate from a carriage of the print head.

9. The method according to claim 1, wherein the camera has a fixed position with respect to the flatbed surface.

10. A flatbed printer comprising:

a flatbed surface for supporting a media object to be printed upon, a control unit for controlling the printing of a digital image on the media object, a print head for ejecting recording material on the media, the print head movable relatively to the flatbed surface according the print head coordinates, and a camera connected to the control unit and positioned above the flatbed surface, the camera configured to capture a camera image from the flatbed surface, wherein the camera has a reach of the whole flatbed surface, wherein the control unit comprises image processing means for detecting a media object placed on the flatbed surface in the camera image captured by the camera and the control unit is configured to derive camera coordinates of the media object in the digital camera image, to convert the camera coordinates indicating a shape and a size of the media object into print head coordinates of the media object using a mapping table, to arrange a digital target image relative to the print head coordinates of the media object, and the print head is configured to print the digital target image on the media object by ejecting recording material on the media object, wherein the mapping table is established prior to printing the digital target image by applying the steps of printing a reference image by the print head on a substrate supported by the flatbed surface, wherein the substrate is separate from the media object and the reference image comprises geometric patterns which are defined in print head coordinates, capturing a reference digital camera image of the printed reference image by means of the camera, detecting the geometric patterns in the reference digital camera image by the control unit, expressing the detected geometric patterns in reference camera coordinates by the control unit, and determining a relation between the reference camera coordinates and the print head coordinates of the detected geometry patterns by the control unit, and wherein the camera has a reach of the whole flatbed surface at one time.

11. The flatbed printer of claim 10, wherein the camera is separate from a carriage of the print head.

12. The flatbed printer of claim 10, wherein the camera has a fixed position with respect to the flatbed surface.

* * * * *